US009597248B2

(12) United States Patent
Davis et al.

(10) Patent No.: US 9,597,248 B2
(45) Date of Patent: Mar. 21, 2017

(54) CASKET SYSTEM INCLUDING ROLLERS AND HEIGHT ADJUSTMENT MECHANISM

(71) Applicant: Vandor Corporation, Richmond, IN (US)

(72) Inventors: Gerald H. Davis, Fountain City, IN (US); Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 14/995,181

(22) Filed: Jan. 13, 2016

(65) Prior Publication Data

US 2016/0235611 A1 Aug. 18, 2016

Related U.S. Application Data

(60) Provisional application No. 62/102,849, filed on Jan. 13, 2015.

(51) Int. Cl.
*A61G 17/04* (2006.01)
*A61G 17/00* (2006.01)

(52) U.S. Cl.
CPC ..... *A61G 17/04* (2013.01); *A61G 2017/004* (2013.01); *A61G 2017/044* (2013.01)

(58) Field of Classification Search
CPC .. A61G 17/04; A61G 2017/044; A61G 17/00; A61G 7/012
USPC ..... 27/12, 27, 35; 5/11, 611
See application file for complete search history.

(56) References Cited

U.S. PATENT DOCUMENTS

| | | | | |
|---|---|---|---|---|
| 2,670,517 | A * | 3/1954 | Hillenbrand | A61G 17/04 248/286.1 |
| 4,524,472 | A * | 6/1985 | Foust | A61G 17/00 108/7 |
| 4,788,757 | A | 12/1988 | Bethune | |
| 7,356,890 | B1 * | 4/2008 | Sauder | A61G 17/00 27/12 |
| 7,904,999 | B2 * | 3/2011 | Steinhaus | A61G 17/00 27/12 |
| 8,127,414 | B2 * | 3/2012 | Rankin | A61G 17/02 27/27 |
| 8,607,423 | B2 | 12/2013 | Davis | |

* cited by examiner

*Primary Examiner* — William Miller
(74) *Attorney, Agent, or Firm* — Maginot, Moore & Beck LLP

(57) ABSTRACT

A casket system includes a casket container and a height adjustment mechanism. The casket container has a bottom, a head end panel, a foot end panel, and rollers supported by the bottom. The height adjustment mechanism includes a threaded shaft, a worm nut, and a crossbar. The threaded shaft extends at least partly in the vertical direction. The shaft is rotatably coupled to the casket container proximate the head end panel. The worm nut is rigidly secured to the crossbar. The worm nut rotatably engages the threaded shaft and translates rotational movement into axial movement along the shaft. The crossbar includes spaced-apart extensions extending from an edge thereof away from the head end panel. The spaced-apart extensions are configured to contact and engage a casket insert that is sized and configured to receive a deceased. The axial movement of the worm nut causes the crossbar to move vertically with respect to the head end panel.

19 Claims, 9 Drawing Sheets

CASKET SYSTEM INCLUDING ROLLERS AND HEIGHT ADJUSTMENT MECHANISM

This application claims the benefit of U.S. patent application Ser. No. 62/102,849, filed Jan. 13, 2015, which is incorporated herein by reference.

BACKGROUND

Caskets are an expensive element of a funeral, and some of the deceased are cremated rather than buried in caskets. Accordingly, rental casket systems can be useful to enable tasteful presentation of the deceased during funeral services, without the necessity of purchasing a casket. Rental casket systems can include a casket, which is rented, and an insert, on which the deceased is lain, which is removably inserted into the casket for presentation of the deceased.

It is important for the insert to be easily inserted into and removed from the casket. Accordingly, some known rental casket systems include a removable panel to enable the insert to be inserted into the casket without having to raise and lower the insert over the sides of the casket. Additionally, some known rental casket systems include rollers positioned along the bottom of the casket to enable the insert to be rolled into and out of the casket. However, these rollers take up space within the casket, leaving less space available for the insert and the deceased within the casket.

It is also desirable for the insert to be repositioned within the casket, specifically to raise a head portion of the insert, to raise the upper body of the deceased and enable a pleasant presentation of the deceased within the casket. Accordingly, some known casket rental systems include a height adjustment mechanism within the casket to raise the head portion of the insert within the casket. However, these height adjustment mechanisms also take up space within the casket. Additionally, the height adjustment mechanisms must be designed to avoid interference with insertion and removal of the insert.

SUMMARY

A rental casket system includes a casket and an insert to be removably received within the casket occupies less space than prior designs. The casket includes a plurality of rollers supported by or in the bottom panel of the casket to facilitate rolling of the insert into and out of the casket. The casket also includes a height adjustment mechanism configured to raise and lower a head end of the insert. The height adjustment mechanism directly engages casket insert itself, thereby eliminating the need to lift other support components.

A first embodiment is a casket system that includes a casket container and a height adjustment mechanism. The casket container has a bottom, a head end panel, a foot end panel, and rollers supported by the bottom. The height adjustment mechanism includes a threaded shaft, a worm nut, and a crossbar. The threaded shaft extends at least partly in the vertical direction. The shaft is rotatably coupled to the casket container proximate the head end panel. The worm nut is rigidly secured to the crossbar. The worm nut rotatably engages the threaded shaft and translates rotational movement into axial movement along the shaft. The crossbar includes spaced-apart extensions extending from an edge thereof away from the head end panel. The spaced-apart extensions are configured to contact and engage a casket insert that is sized and configured to receive a deceased. The axial movement of the worm nut causes the crossbar to move vertically with respect to the head end panel.

Other embodiments further include the removable casket insert, which includes openings or throughholes to receive the spaced-apart extensions. In some embodiments, the removable casket inserts include the throughholes on an end panel thereof. In other embodiments, the removable casket inserts include throughholes on a bottom panel thereof.

DETAILED DESCRIPTION

Figure 1A:
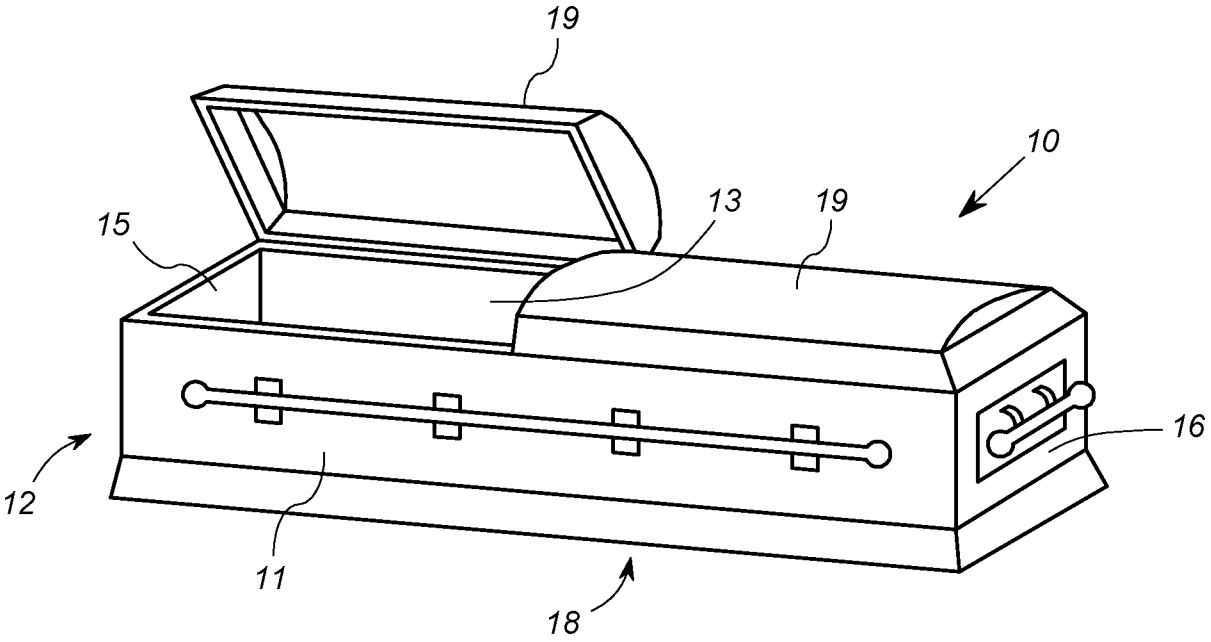
FIG. 1A shows a perspective view of an exemplary casket container of a casket system to a first embodiment.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Figure 1B:
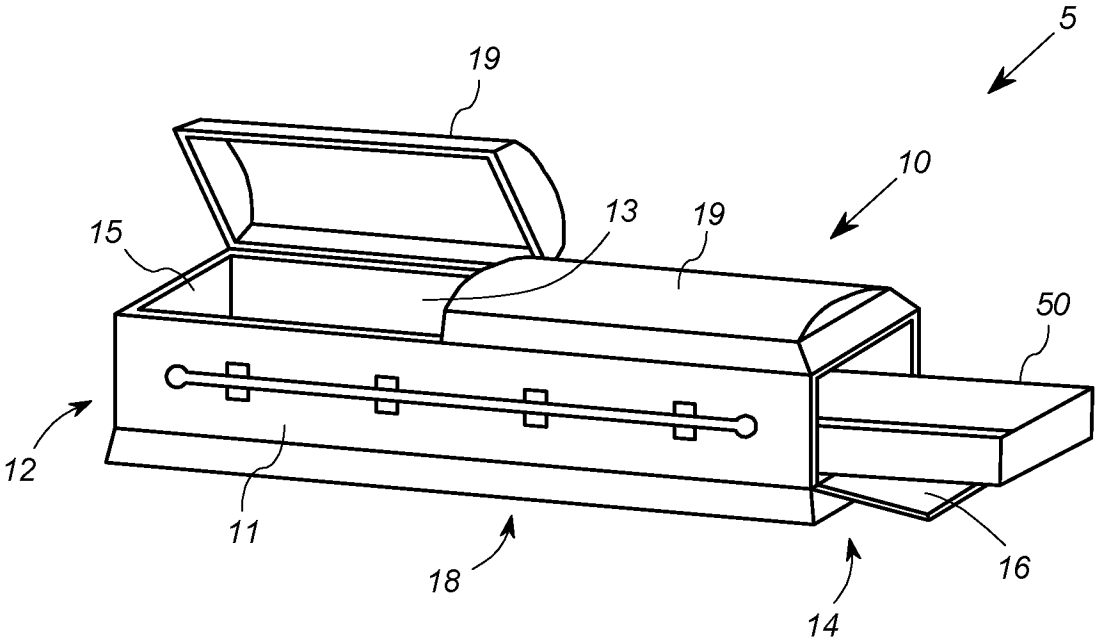
FIG. 1B shows a perspective view of the casket system of FIG. 1A, wherein a casket insert is partially inserted into the casket container of FIG. 1A.

FIGS. 1A, 1B, 2 and 3 collectively show an exemplary casket system 5 that includes a casket container 10, a casket insert 50 (see FIG. 1B) and a height adjustment mechanism 176 (see FIGS. 2 and 3) in accordance with at least a first embodiment of the invention. FIG. 1A shows a perspective view of the casket container 10 closed for funeral use. FIG. 1B shows a perspective view of the casket insert 50 partially inserted into the casket container 10. In general, the casket container 10 may suitably be a substantial structurally and aesthetically pleasing for viewing a deceased. By way of example, the casket container 10 may be constructed of hardwood, or laminated wood. The casket insert 50 is an open container that may be used as transport and support mechanism for the deceased. The casket insert 50 is configured to slide into and out of the casket container 10 at a first end thereof. FIG. 1B shows the casket insert 50 partially inserted into the casket container 10.

Referring to FIGS. 1A and 1B, the casket container 10 include side panels 11, 13, a head end panel 15 and a foot end panel 16 arranged in an elongate box that includes a head portion 12 and a foot portion 14. The casket container 10 is sized and configured to receive and display a human deceased in the supine position. The foot portion 14 is the portion of the casket container proximate the foot end panel 16. As is known in the art, the foot end panel 16 is pivotally attached to can pivot between an open position to receive the insert 50 (shown in FIG. 1B) and a closed position (shown in FIG. 1A) to retain the insert 50. In an alternative embodiment, the foot panel 16 can be completely removable, or a portion thereof complete removable or pivotally attached. In any event, the casket container 10 also includes a bottom 18, and a conventional lid 19.

Figure 2:
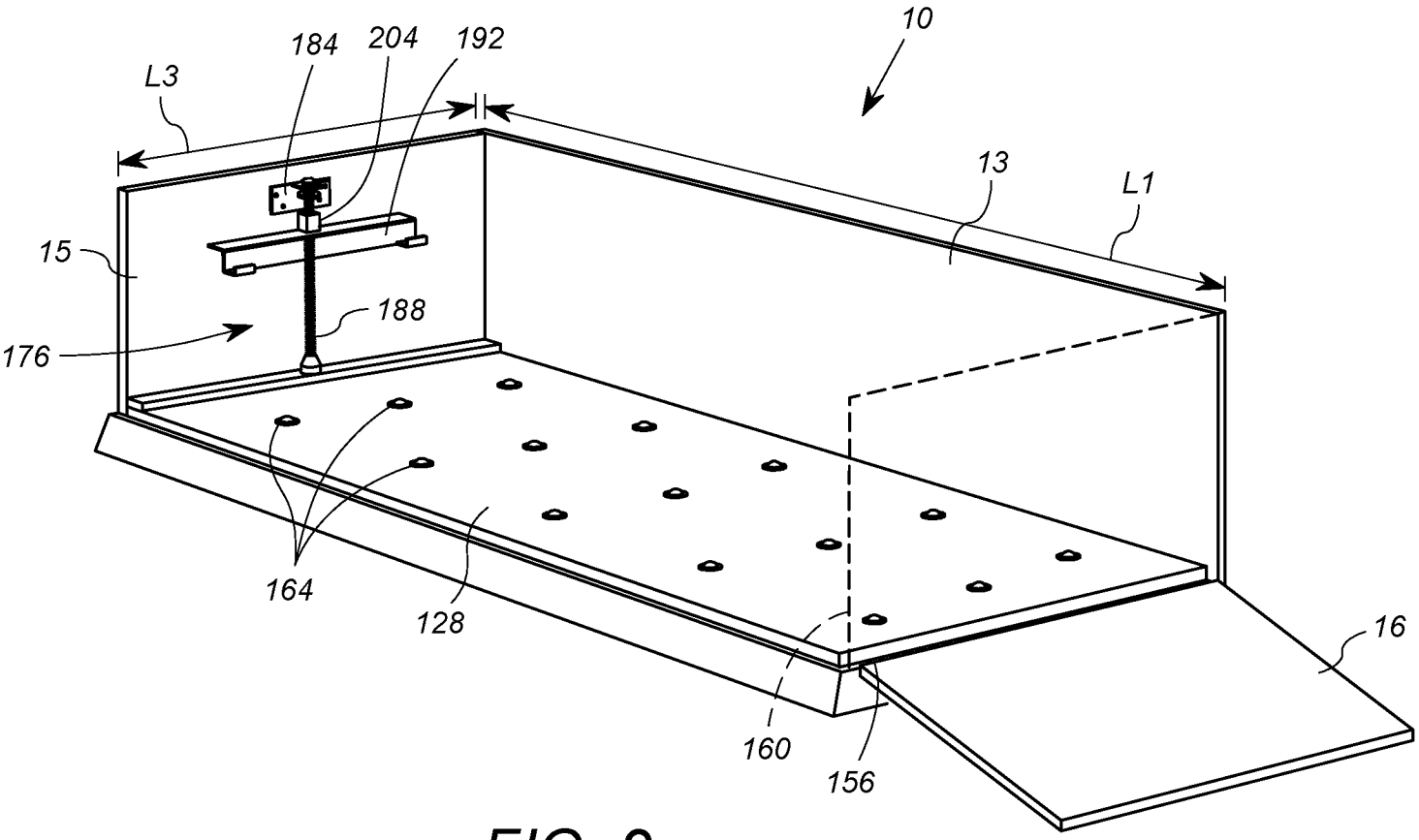
FIG. 2 shows a perspective fragmentary view of the casket container and height adjustment mechanism of the casket system shown in FIG. 1A.
Figure 3:
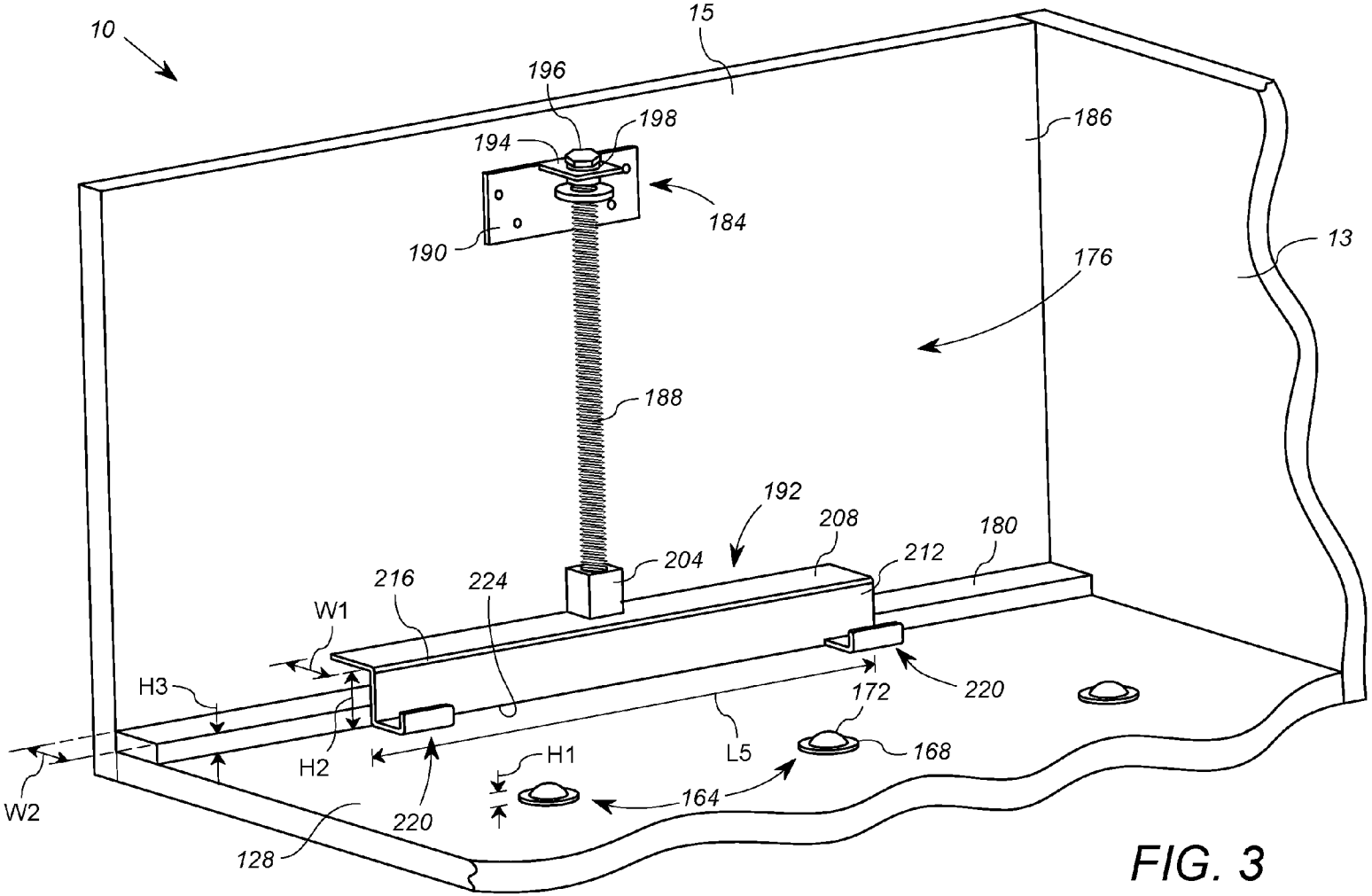
FIG. 3 shows an enlarged perspective fragmentary view of the casket container and height adjustment mechanism of the casket system shown in FIG. 1A, with the height adjustment mechanism in a lowermost position.

FIG. 2 shows a fragmentary perspective view of the casket system 5 with the side panel 11 removed for clarity of exposition of the interior, and without the insert 50. FIG. 3 shows an enlarged fragmentary perspective view illustrating in detail the height adjustment mechanism 176. As illustrated more clearly in FIGS. 2 and 3, the casket container 10 includes, in addition to the head end panel 15, the foot end panel 16 and side panels 11, 13 (see FIGS. 1A and 1B), a bottom panel 128 and a plurality of rollers 164 supported by said bottom panel (or simply "bottom") 128.

The height adjustment mechanism 176 includes a threaded shaft 188, and a worm nut 204 rigidly secured to a crossbar 192. The threaded shaft 188 extends at least partly in the vertical direction, which is defined as the height direction of the casket container 10. The threaded shaft 188 has first and second ends and is rotatably coupled to the casket container 10 proximate the head end panel 15. The worm nut 204 rotatably engages the threaded shaft 188 and is configured translate rotational movement into axial movement along the shaft 188. The crossbar 192 includes a plurality of spaced-apart extensions 220 extending from an edge 224 thereof, in a direction away from the head end panel 15. As will be discussed below in detail, the spaced-apart extensions 220 are configured to contact and engage a portion of the casket insert 50. It will be appreciated that axial movement of the worm nut 204 causes the crossbar 192 to move vertically with respect to the head end panel.

As shown in FIG. 2, a bottom 128 of the casket container 10 includes a plurality of rollers 164 permanently coupled to the bottom 128 of the casket container 10. The rollers 164 are configured to roll along a bottom 152 of the insert 50 to facilitate insertion of the insert 50 into the casket container 10, to support the insert 50 within the casket container 10, and to roll to facilitate removal of the insert 50 from the casket container 10. The rollers 164 enable easy insertion and removal of the insert 50 and minimally reduce the amount of space available for the insert 50 within an interior space of the casket container 10.

Figure 5:
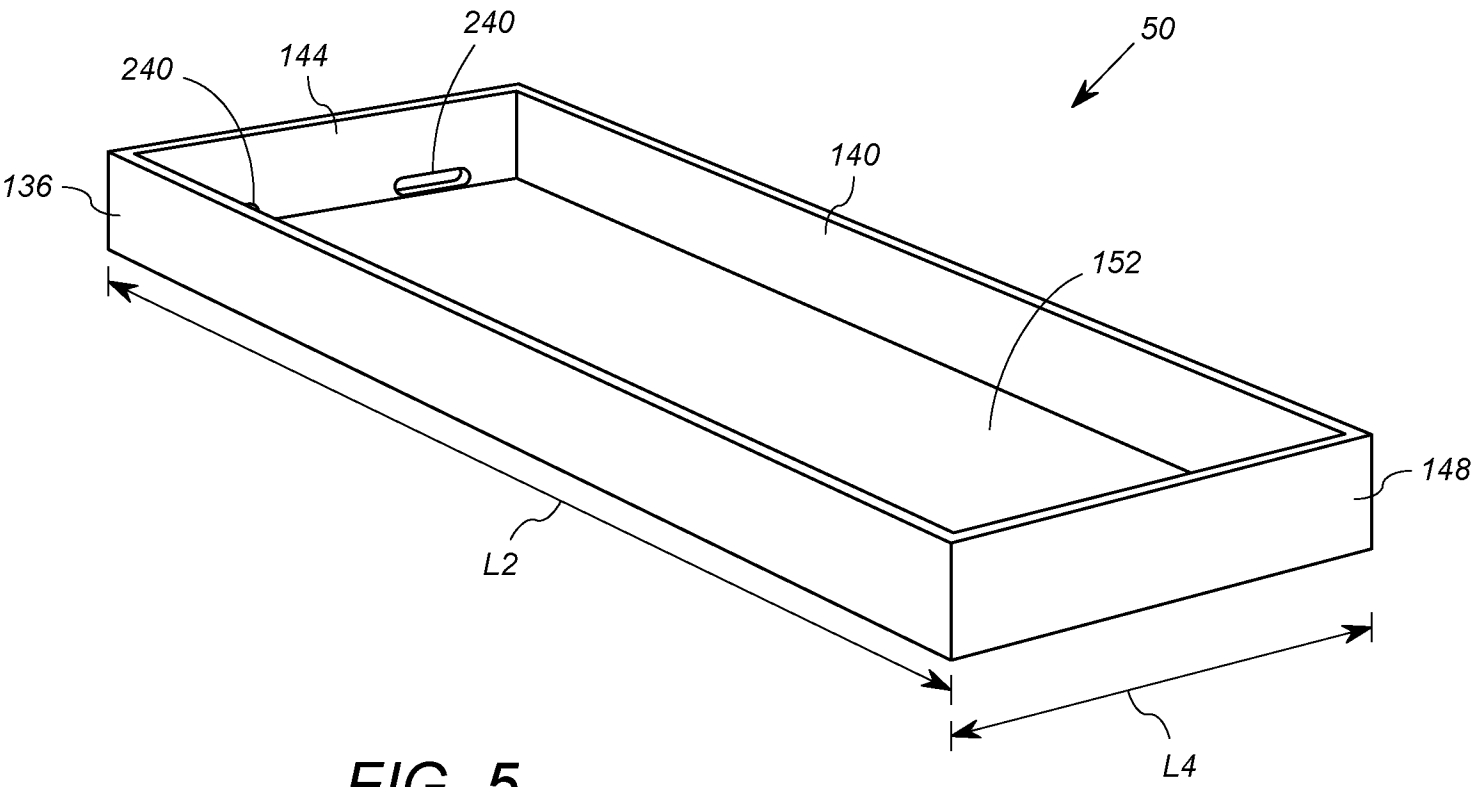
FIG. 5 shows a perspective view of the casket insert of the casket system shown in FIG. 1A apart from the casket container.
Figure 6:
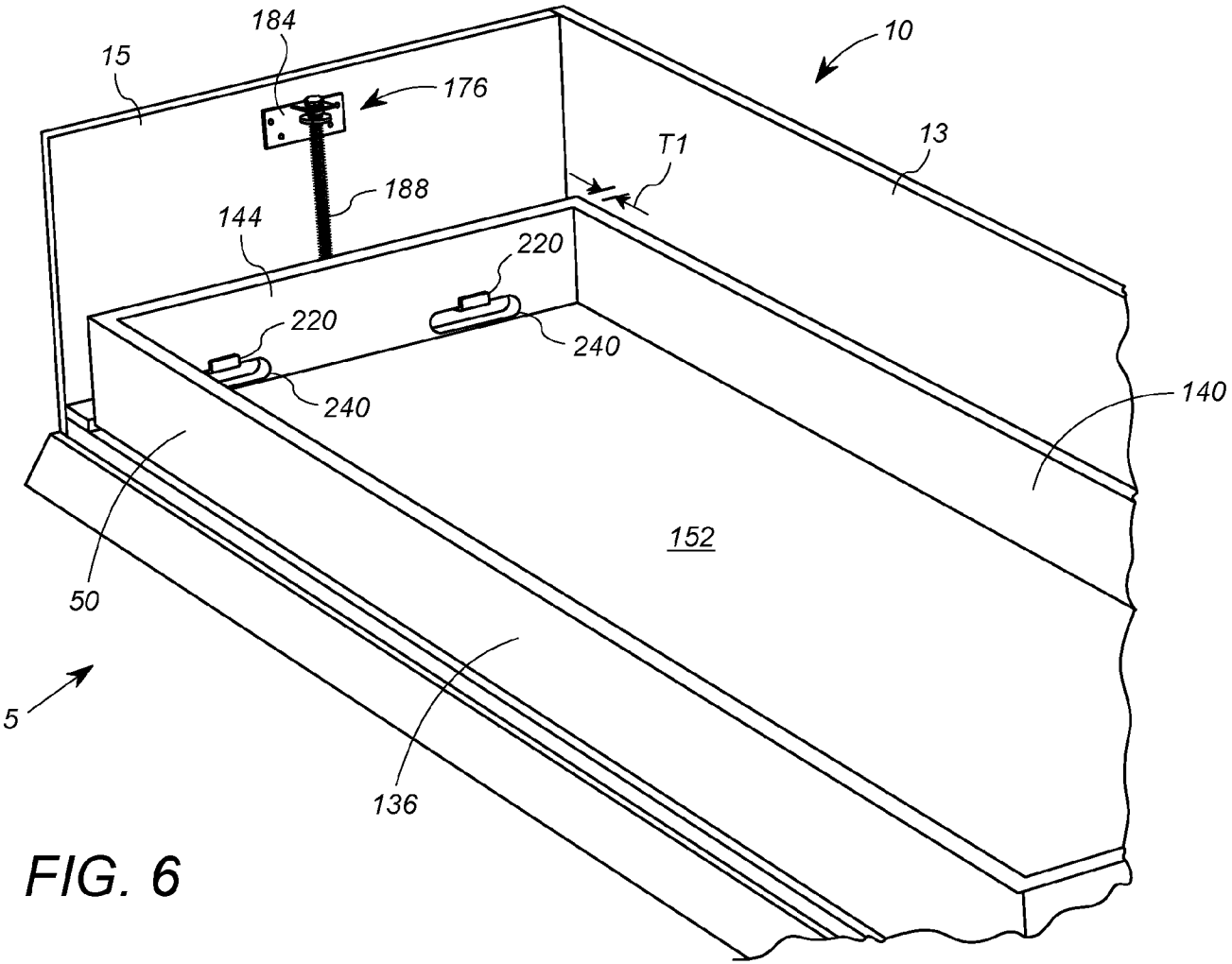
FIG. 6 shows a perspective fragmentary view of the casket system of FIG. 1A with the casket insert in the lowermost position.

Further shown in FIG. 2, the height adjustment mechanism 176 is rotatably coupled to the head end panel 15. In general, the height adjustment mechanism 176 is configured to raise and lower a head end 144 of the insert 50 (shown in FIG. 5). Referring now to FIG. 5, the insert 50 includes openings 240 formed in the head end 144 and configured to engage with the height adjustment mechanism 176 when the insert 50 is disposed within the casket container 10. FIG. 6 shows the insert 50 within the container 10 and coupled to the height adjustment mechanism, wherein the height adjustment mechanism 176 is in a first axial position, which is the lowest position. As will be discussed below in detail, the interaction of the height adjustment mechanism 176 while coupled to the insert 50 via the openings 240 enable the deceased, lain on the insert 50 within the casket container 10, to be temporarily positioned within the casket container 10 in a way which is favorable for viewing, such as at a funeral service.

As illustrated in FIG. 1B, the insert 50 is configured to be removably received within the interior space of the casket container 10. Referring again to FIGS. 5 and 6, the insert 50 is shaped as a rectangular tray or box with an open top, having a length and width (but not height) substantially similar to the casket container 10. To this end, the insert 50 includes a front wall 136, a back wall 140, the head end 144, a foot end 148, and the bottom 152 arranged in substantially the same shape as the casket container 10. When the insert 50 is received within the interior space of the casket container 50, the bottom 152 of the insert 50 rests on the rollers 164 (see FIG. 2) included in the bottom 128 of the casket container 10.

The insert 50 may be made of wood, particle board, corrugated paper, or the like. The insert 50 preferably is consumable in a cremation facility. In general, the insert 50 may have the general structure of the insert shown in FIG. 5 of U.S. Pat. No. 8,607,423, the content of which is incorporated herein by reference in its entirety.

As shown in FIG. 2 the side wall 13 of the casket container 10 has a length L1 extending between the head end 12 and the foot end 14 of the casket container 10. As shown in FIG. 1A, the side wall 11 has the same length. Similarly, as shown in FIG. 5, the front and back walls 136, 140 of the insert 50 have a length L2 extending between the head end 144 and the foot end 148 of the insert 50. In the same way, the head end 12 and foot end 14 of the casket container 10 (shown in FIG. 2) have a length L3 extending between the side walls 11, 13 of the casket container 10. The head end 144 and foot end 148 of the insert 50 (shown in FIG. 3) have a length L4 extending between the front wall 136 and the back wall 140 of the insert 50. The length L2 of the insert 50 is shorter than the length L1 of the casket container 10 (shown in FIG. 2), and the length L4 of the insert 50 is shorter than the length L3 of the casket container 10 (shown in FIG. 2) to enable the insert 50 to fit within the casket container 10 as shown in FIGS. 1A, 1B.

Returning now to FIGS. 1B and 2, the foot end panel 16 of the casket container 10 is hingedly coupled to the bottom 128 of the casket container 10 at an edge 156 to enable the foot end 124 to rotate outwardly and downwardly about the edge 156. FIG. 1A shows the foot end panel 16 of the casket container 10 in an upright position, and FIGS. 1B and 2 show the foot end panel 16 in a downward position wherein the foot end panel 16 is no longer parallel to the head end panel 15 and is no longer perpendicular to the side walls 11, 13 and the bottom 128 of the casket container 10. When the foot end panel 16 is in the downward position, the insert 50 can be inserted and removed from the casket container 10 through a space 160 that the foot end panel 16 occupies when it is in the upright position.

As mentioned above, FIG. 2 shows the casket container 10 (and height adjustment mechanism 176) without the insert 50, with the front wall 11 removed, for clarity, and with the foot end panel 16 in the downward position. Each roller 164 of the plurality of rollers 164 is permanently coupled to the bottom 128 of the casket container 10 and projects upwardly therefrom to support the insert 50. The rollers 164 are spaced apart along the bottom 128 of the casket container 10 to distribute the load of the insert 50 among the rollers 164, enabling the insert 50 to roll easily into and out of the casket container 10. Accordingly, the number of rollers 164 and the spacing of the rollers 164 are selected to facilitate easily rolling the insert 50. In the embodiment shown, the casket container 10 includes fifteen rollers 164. However, it is possible for the casket container 10 to include more or fewer than fifteen rollers 164.

As shown more clearly in FIG. 3, each roller 164 in this embodiment includes a seat 168 and a ball 172. Each seat 168 is permanently inserted on or into the bottom 128 of the casket container 10, and each ball 172 is received within a respective seat 168 such that it is free to rotate within the seat 168 but is trapped within the seat 168. It will be appreciated that in some embodiments, the bottom and sides of the seat 168, not shown, may include part of the material of the bottom panel 128. The portions of the balls 172 which are arranged at the uppermost points of the rollers 164 project above the bottom 128 of the casket container 10 by a height H1. Thus, the insert 50 (shown in FIG. 3), which is supported by the portions of the balls 172 arranged at the uppermost points of the rollers 164, is supported at the height H1 when received within the casket container 10.

With continued reference to FIG. 3, the head end panel 15 of the casket container 10 includes the height adjustment mechanism 176 configured to enable adjustment of the height of the head end 144 of the insert 50 (shown in FIG. 6) when the insert 50 is received within the casket container 10. The height adjustment mechanism 176 includes a base support bar 180, a support plate 184, a threaded shaft 188, and a supporting cross bar 192. The base support bar 180 is coupled to the bottom 128 of the casket container 10, abutting the head end panel 15 of the casket container 10, and extends along the entire length L3 (shown in FIG. 2) of the head end panel 15. The base support bar 180 is configured to rotatably couple the threaded shaft 188 to the bottom 128 of the casket container 10. To this end, the base support bar 180 can be made out of wood, plastic, or another rigid material which can be securely fastened to the bottom 128 of the casket container 10.

The support plate 184 is coupled to the head end panel 15 facing into the interior space of the casket container 10. The support plate 184 is positioned in approximately the center of the length L3 (shown in FIG. 2) and within a top area 186 of the head end panel 15 of the casket container 10. The support plate 184 is configured to rigidly and securely couple the threaded shaft 188 to the head end panel 15 of the casket container 10. To this end, the support plate 184 includes a vertical portion 190, fastened to the head end panel 15 of the casket container 10, and a horizontal portion 194, projecting inwardly from the vertical portion 190 into the interior space of the casket container 10. The horizontal portion 194 includes a hole 198 configured to receive a portion of the threaded shaft 188 therethrough to securely couple the threaded shaft 188 to the head end panel 15 of the casket container 10.

The threaded shaft 188 is coupled between the base support bar 180 and the support plate 184 such that the threaded shaft 188 can be rotated relative to the casket container 10. In the embodiment shown, the threaded shaft 188 is rotated by rotating a hex head 196 rigidly secured to and located at the top of the threaded shaft 188, above the support plate 184. However, in alternative embodiments, the threaded shaft 188 can be rotated in a different manner which enables the threaded shaft 188 to be held in place by the base support bar 180 and the support plate 184 while it is rotated.

The supporting cross bar 192 is coupled to the threaded shaft 188 by the worm nut 204 such that rotation of the threaded shaft 188 in a first direction causes the supporting cross bar 192 to be moved upwardly on the threaded shaft 188 and rotation of the threaded shaft 188 in an opposite, second direction causes the supporting cross bar 192 to be moved downwardly on the threaded shaft 188. The supporting cross bar 192 is configured to rigidly and stably support the head end 144 of the insert 50 (shown in FIG. 6) while the height of the head end 144 is being adjusted by the height adjustment mechanism 176. To this end, the supporting cross bar 192 can be made out of wood, plastic, or another rigid, lightweight material.

The supporting cross bar 192 includes a horizontal portion 208 having a hole (not shown) which is aligned with the worm nut 204 and is configured to pass the threaded shaft 188 therethrough. The supporting cross bar 192 also includes a vertical portion 212 coupled to the horizontal portion 208 at a bend 216 such that the vertical portion 212 extends downwardly, toward the bottom 128 of the casket container 10 from the horizontal portion 208. The horizontal portion 208 and the vertical portion 212 are perpendicular to one another such that the bend 216 forms a right angle. The horizontal portion 208 and the vertical portion 212 both have a length L5 extending in the direction from the front wall 112 (shown in FIG. 1) toward the back wall 116 (shown in FIG. 2) of the casket container 10. The length L5 can be, for example, approximately 9 inches. However, it is possible for the length L5 to be greater or less than 9 inches. As the supporting cross bar 192 is raised and lowered along the threaded shaft 188, the orientation of the supporting cross bar 192 is maintained such that the horizontal portion 208 and the vertical portion 212 remain parallel to the bottom 128 of the casket container 10 and perpendicular to the threaded shaft 188 and the side walls 11, 13 of the casket container 10.

The horizontal portion 208 of the supporting cross bar 192 has a width W1 which is greater than a width W2 of the base support bar 180, and the vertical portion 212 of the supporting cross bar 192 has a height H2 which is greater than a height H3 of the base support bar 180. Thus, the supporting cross bar 192 is able to be lowered down, via the threaded shaft 188 and worm nut 204, to a lowermost position (shown in FIGS. 3 and 6), wherein a bottom edge 224 of the vertical portion 212 rests on the bottom 128 of the casket container 10, without interference from the base support bar 180. In other words, in the lowermost position (shown in FIG. 3), the supporting cross bar 192 fits over the base support bar 180.

Figure 4:
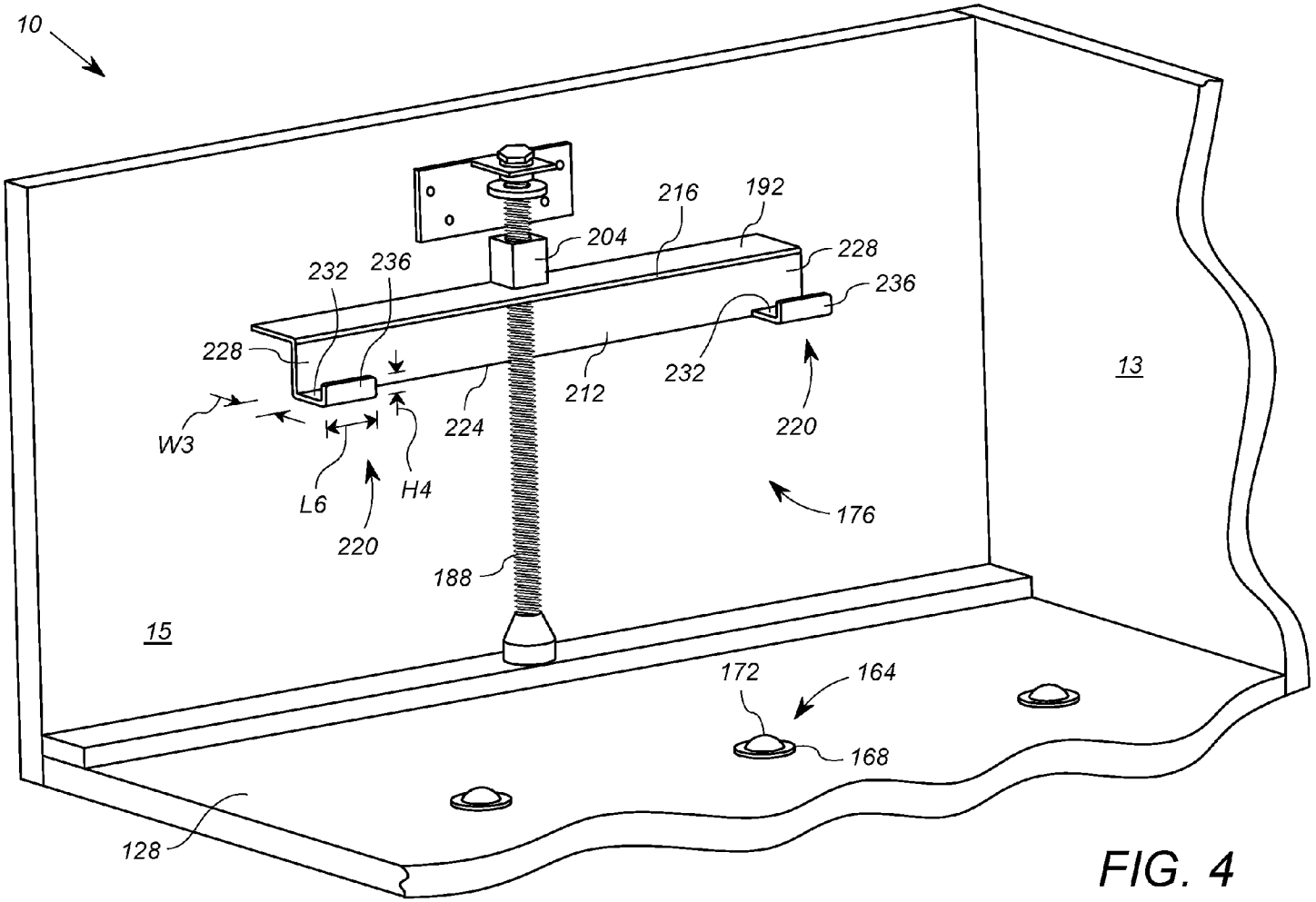
FIG. 4 shows an enlarged perspective fragmentary view of the casket container and height adjustment mechanism of the casket system shown in FIG. 1A, with the height adjustment mechanism in a uppermost position.

The supporting cross bar 192 of the height adjustment mechanism 176 can be raised along the threaded shaft 188, by rotating the threaded shaft 188 in the first direction, causing the worm nut 204 to travel upwardly along the threaded shaft 188 from the lowermost position shown in FIGS. 3 and 6 toward its uppermost position, shown in FIGS. 2 and 4. Because of the operation of the threaded shaft 188 and worm nut 204, the support cross bar 192 may rest in the lowermost position (e.g. FIG. 3), the uppermost position (e.g. FIG. 4), and any point in between.

Referring to FIGS. 3 and 6, in order to vertically move the insert 50, the spaced-apart extensions 220 engage, contact and support the head end 144 of the insert 50. To this end, the extensions 220 project inward (away from the head end panel 15) from the bottom edge 224 of the vertical portion 212 of the supporting cross bar 192 arranged opposite the bend 216. The extensions 220 are configured to engage with the openings 240 in the head end 144 of the insert 50 (shown in FIG. 6) to couple the head end 144 of the insert 50 to the height adjustment mechanism 176. To distribute the weight of the head end 144 of the insert 50 along the supporting cross bar 192, the extensions 220 are arranged at opposite ends 228 of the vertical portion 212. In the embodiment shown, the supporting cross bar 192 includes two extensions 220 to distribute the weight of the head end 144 of the insert 50 while stably supporting the head end 144. However, in alternative embodiments, the supporting cross bar 192 can include more than two extensions 220.

Each extension 220 includes a support portion 232, configured to bear the weight of the head end 144 of the insert 50, and a tab hook or simply tab portion 236, configured to engage with and retain the head end 144 of the insert 50. The support portions 232 are coupled to the vertical portion 212 and project perpendicularly, inwardly from the vertical portion 212. In other words, the support portions 232 are parallel to and arranged beneath the horizontal portion 208 and project away from the head end panel 15 of the casket container 10. Each tab hook 236 projects perpendicularly and upwardly from a respective support portion 232. In other words, the tab hooks 236 extend parallel to, and spaced apart from, the vertical portion 212. In this embodiment, the hooks 236 project away from the bottom 128 of the casket container 10. However, it will be appreciated that the tab hooks 236 need not extend completely vertically, or even upwardly, so long as they extend at an angle that differs from that of the support portions 232. Nevertheless, an upward extending hooked element would be more effective at retaining the insert 50 in the upper positions.

Each of the extensions 220 has a length L6 extending in the direction from the front wall 112 toward the back wall 116 of the casket container 10. The head end 144 of the insert 50 is supported along the lengths L6 of the extensions 220. Accordingly, the lengths L6 are sufficient to provide a stable and secure contact surface area for the head end 144 on the height adjustment mechanism 176. In the embodiment shown, the length L6 of each of the extensions 220 is approximately one inch. In other embodiments, however, the length L6 of each of the extensions 220 can be greater or less than one inch, but preferably no more than four inches. The support portions 232 project inwardly from the vertical portion 212, in the direction into the interior space of the casket container 10, by a width W3 and the tab portions 236 project upwardly from the support portions 232, in the direction away from the bottom 128 of the casket container 10, by a height H4.

In order to facilitate engagement of the casket insert 50 with the height adjustment mechanism 176 upon insertion of the casket insert 50, it will be appreciated that the worm nut 204 and crossbar 192 are configured such that at a position at or near the lowermost position, the spaced-apart extensions 220 align with and engage holes 240 while the insert 50 rests on the plurality of rollers 164. It will be appreciated that at higher positions, crossbar 192 and extensions 220 lift the insert 50 off of some or most of the plurality of rollers 164.

Specifically referring to FIG. 6, the insert 50 is shown fully inserted into the casket container 10, and the height adjustment mechanism 176 is shown in an intermediate position such that the supporting cross bar 192 (shown in FIG. 6) is raised slightly above the bottom 128 of the casket container 10. This position of the supporting cross bar 192 enables the extensions 220 of the supporting cross bar 192 to be aligned with, and received within, the openings 240 in the head end 144 of the insert 50. Thus, this position enables the head end 144 of the insert 50 to be positioned above the support portion 232 (shown in FIG. 6) of the supporting cross bar 192 and enables the tab portions 236 (shown in FIG. 6) of the supporting cross bar 192 to be positioned above the bottom 152 of the insert 50.

Figure 7:
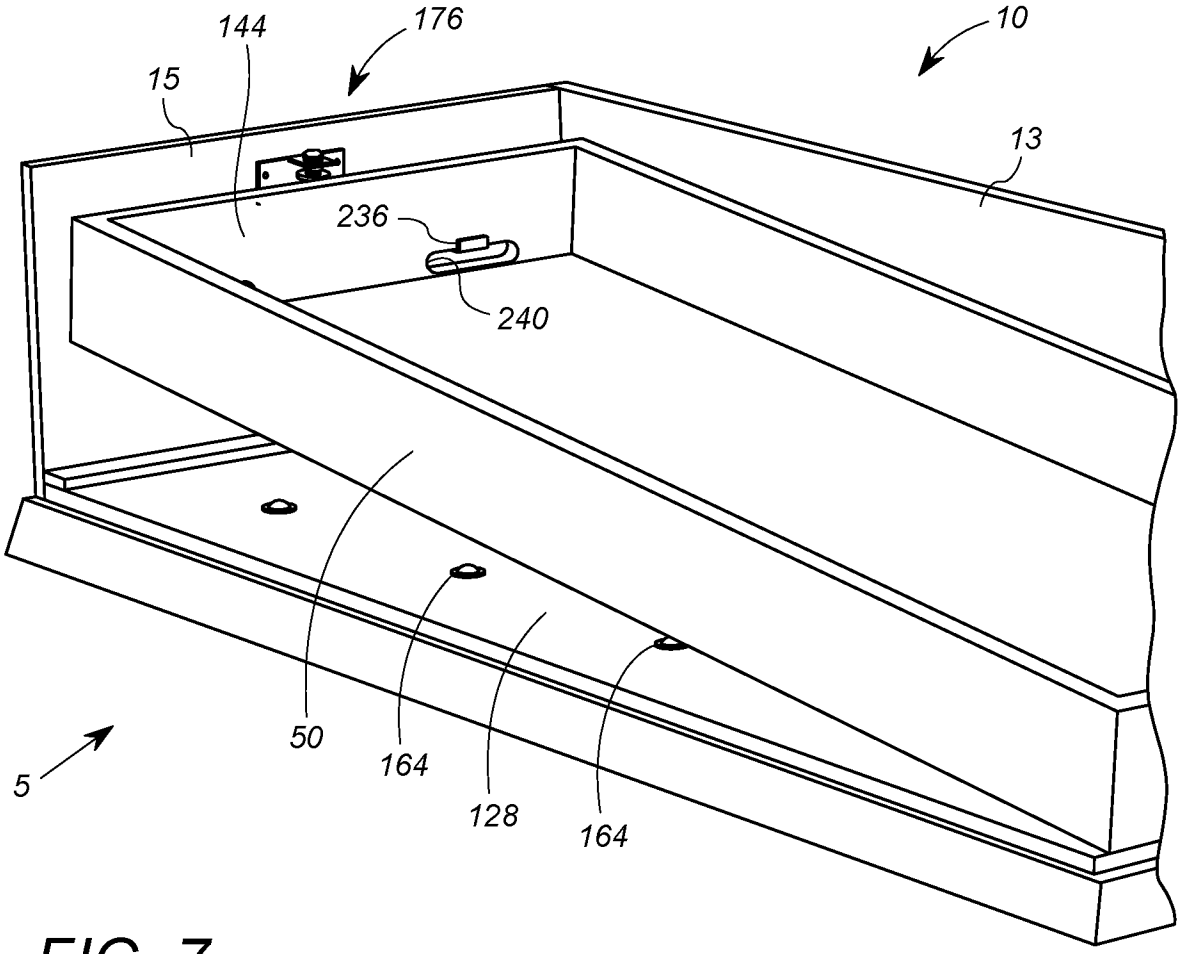
FIG. 7 shows a perspective fragmentary view of the casket system of FIG. 1A with the casket insert in the uppermost position.

FIG. 7 shows another perspective, fragmentary view of the casket system 5 wherein the side 11 of the casket container 10 has been removed. As shown in FIG. 7, further raising the supporting cross bar 192 (shown in FIGS. 3 and 4) causes the extensions 220 to engage with the head end 144 of the insert 50 via the openings 240 to life the insert 50. To this end, the width W3 (shown in FIG. 4) of the support portions 232 of the extensions 220 is greater than a thickness T1 of the head end 144 of the insert 50 to enable the head end 144 to fit onto the support portions 232 of the supporting cross bar 192. The tab portions 236 (shown in FIG. 7) prevent the head end 144 from sliding off the support portions 232 (shown in FIG. 4) when the supporting cross bar 192 (shown in FIG. 4) is raised higher along the threaded shaft 188 to the uppermost position, as shown in FIGS. 4 and 7.

In operation, a deceased is positioned with the insert 50 while the insert 50 is outside of the casket container 10. To place the insert 50 and deceased, not shown, within the casket container 10, the foot end panel 16 is rotated down to provide an opening to the interior of the casket container 10. The removable casket insert 50 is then slid (or rolled) into the casket container 10 by rolling the casket insert 50 on the plurality of rollers 164 disposed on the bottom 128. (See FIG. 1B). Once the casket insert 50 is fully within the casket container 10, the plurality of spaced-apart extensions 220 are disposed through openings 240 in the insert 50, thus engaging the insert 50 to the extensions 220. The worm screw 204 is then rotated to cause axial movement of the crossbar 192 and thus at least a portion of the removable insert 50. The foot end panel 16 may be replaced in the upright position as shown in FIG. 1A. Additional dressing of the casket system 5 may occur to obscure direct sight of the casket insert. After the viewing, the reverse process may be used to remove the casket insert 50 and the deceased from the container 10.

Figure 8:
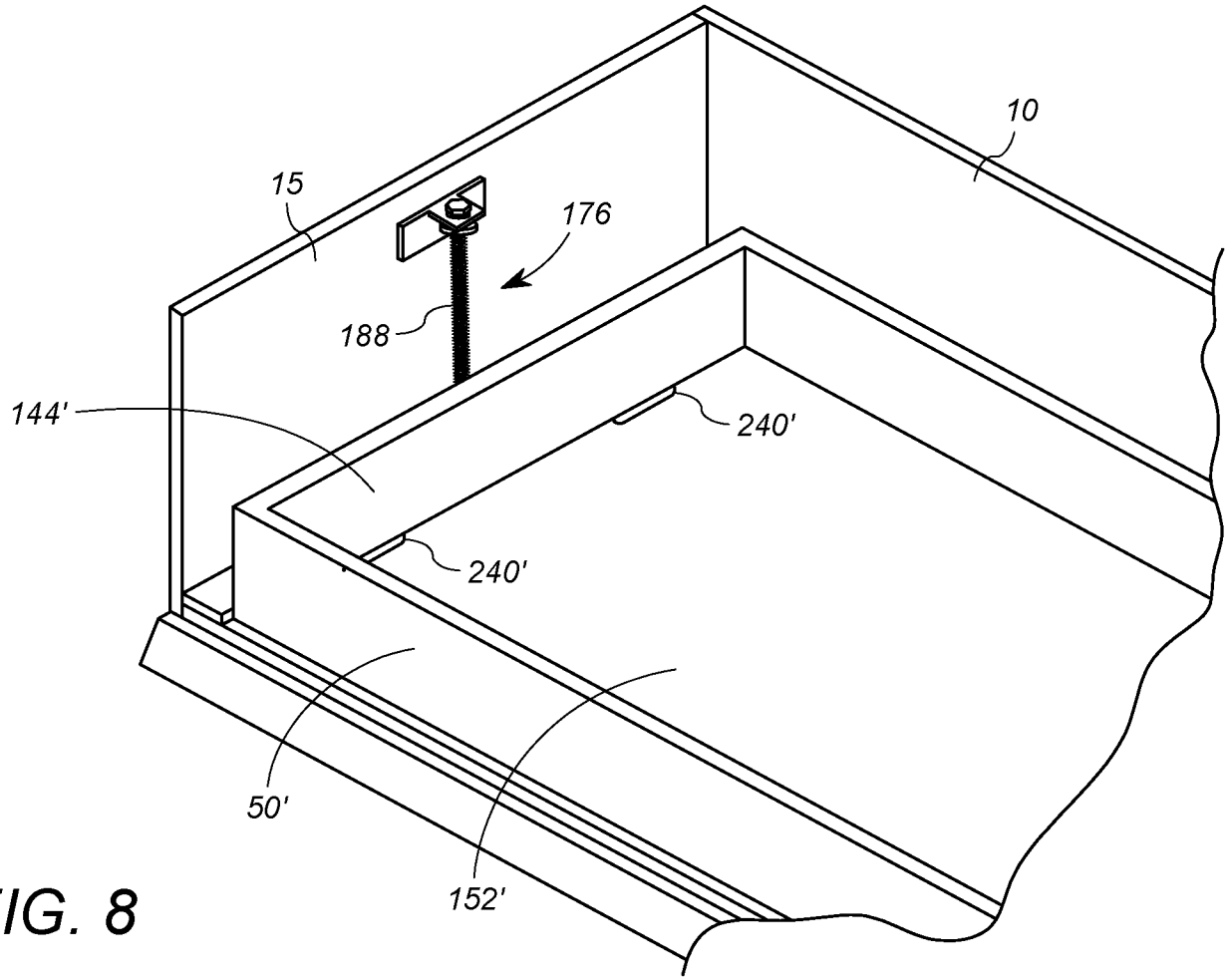
FIG. 8 depicts a perspective fragmentary view of a casket system having an alternative embodiment of a casket insert.

FIG. 8 shows a perspective, fragmentary view of the casket container 10, with the side panel 11 removed, the height adjustment mechanism 176, and an alternative embodiment of a casket insert 50'. In an alternative embodiment, shown in FIG. 8, an alternative insert 50' is substantially similar to the insert 50 described above and shown in FIGS. 1, 5, 6, and 7, except that insert 50' includes openings 240' formed in the bottom 152' of the insert 50' rather than in the head end 144', as in the insert 50. In this embodiment, the height H4 (shown in FIG. 4) of the tab portions 236 (shown in FIG. 4) of the height adjustment mechanism 176 is smaller than the height H1 (shown in FIG. 3) of the rollers 164 (shown in FIG. 3) so that, when the insert 50' is fully inserted into the casket container 10, the head end 144' can pass over the tab portions 236 (shown in FIG. 3) to position the head end 144' above the support portions 232 (shown in FIG. 3) and the openings 240' above the tab portions 236 (shown in FIG. 3) of the height adjustment mechanism 176.

When the supporting cross bar 192 is raised to a higher position similar to that shown in FIG. 7, the tab portions 236 project upwardly through the openings 240' in the bottom 152' to engage and retain the head end 144' of the insert 50' on the support portions 232 of the supporting cross bar 192. Thus, when the supporting cross bar 192 is raised to the uppermost position, the head end 144' of the insert 50' is prevented from sliding off the supporting cross bar 192 of the height adjustment mechanism 176.

It will be appreciated that the above-described embodiments are merely illustrative, and that those of ordinary skill in the art may readily device their own implementations and modifications that incorporate the principles of the present invention and fall within the spirit and scope thereof.

What is claimed is:

1. A casket system comprising:

a casket container having a bottom, a head end panel, and a foot end panel, said casket container including a plurality of rollers supported by said bottom;

a threaded shaft extending at least partly in the vertical direction, and having first and second ends, the threaded shaft rotatably coupled to the casket container proximate the head end panel;

a worm nut rigidly secured to a crossbar, the worm nut rotatably engaging the threaded shaft and configured translate rotational movement into axial movement along the shaft, the crossbar including a plurality of spaced-apart extensions extending from an edge thereof away from the head end panel, the spaced-apart extensions configured to contact and engage a portion of a casket insert, the casket insert sized and configured to receive a deceased; and wherein the axial movement of the worm nut causes the crossbar to move vertically with respect to the head end panel.

2. The casket system of claim 1, wherein the worm nut and crossbar are configured to have a first vertical position in which the spaced-apart extensions configured to engage the portion of the casket insert while the casket insert rests on at least a first set of the plurality of rollers, and to have a second vertical position in which the casket insert is spaced apart from the first set of the plurality of rollers when engaged by the spaced-apart extensions.

3. The casket system of claim 1, further comprising a support secured to the head end panel, the support including a horizontal plate having a hole for receiving and rotatably securing worm screw proximate the first end.

4. The casket system of claim 3, further comprising a base support bar disposed adjacent to the head end panel and disposed on the bottom, and wherein the second end of the threaded shaft is rotatably coupled via the base support bar, the base support bar having a base width extending in the direction away from the head end panel, and a base height extending in the direction away from the bottom.

5. The casket system of claim 4, wherein the crossbar further includes a horizontal portion secured to the worm nut and a vertical portion including the edge from which the plurality of spaced-apart extensions extend; and the horizontal portion has a crossbar width that exceeds the base width, and the vertical portion has a crossbar height that exceeds the base height.

6. The casket system of claim 5, wherein each of the plurality of spaced-apart extensions includes a support portion and tab hook portion, the support portion extending in a first direction and defining an insert weight bearing surface, and the tab hook extending in a second direction from an end of the support portion.

7. The casket system of claim 1, wherein the second end of the threaded shaft is rotatably coupled at least indirectly to the bottom at a position below the crossbar; and the crossbar further includes a horizontal portion secured to the worm nut and a vertical portion including the edge from which the plurality of spaced-apart extensions extend.

8. The casket system of claim 7, wherein each of the plurality of spaced-apart extensions includes a support portion and tab hook portion, the support portion extending in a first direction and defining an insert weight bearing surface, and the tab hook extending in a second direction from an end of the support portion.

9. The casket system of claim 1, wherein each of the plurality of spaced-apart extensions includes a support portion and tab hook portion, the support portion extending in a first direction and defining an insert weight bearing surface, and the tab hook extending in a second direction from an end of the support portion.

10. The casket system of claim 1, wherein at least a first of the plurality of rollers comprises a seat disposed in the bottom and ball disposed within the seat.

11. A casket system comprising:

a removable insert configured to support remains of a deceased;

a casket container having a bottom, a head end panel, and a foot end panel, said casket container including a plurality of rollers supported by said bottom, said casket container configured to receive the removable insert;

a threaded shaft extending at least partly in the vertical direction, and having first and second ends and rotatably coupled to the casket container proximate the head end panel;

a worm nut rigidly secured to a crossbar, the worm nut rotatably engaging the worm shaft and configured translate rotational movement into axial movement along the threaded shaft, the crossbar including a plurality of spaced-apart extensions extending from an edge thereof away from the head end panel, the spaced-apart extensions configured to engage a portion of the removable insert; and wherein the axial movement of the worm nut causes the crossbar to move vertically with respect to the head end panel thereby raising and lowering the removable insert within the casket container.

12. The casket system of claim 11, wherein the worm nut and crossbar are configured to have a first vertical position in which the spaced-apart extensions configured to engage the portion of the removable insert while the removable insert rests on at least a first set of the plurality of rollers, and to have a second vertical position in which the removable insert is spaced apart from the first set of the plurality of rollers when engaged by the spaced-apart extensions.

13. The casket system of claim 12, wherein:

the foot end panel is moveable between an open position and a closed position, the open position configured to allow the removable insert to be moved into and out of the casket container while engaging the plurality of rollers, the closed position forming a barrier inhibiting movement of the casket container out of the casket container on the plurality of rollers.

14. The casket system of claim 13, further comprising a support secured to the head end panel, the support including a horizontal plate having a hole for receiving and rotatably securing threaded shaft proximate the first end.

15. The casket system of claim 14, wherein each of the plurality of spaced-apart extensions includes a support portion and tab hook portion, the support portion extending in a first direction and engaging the removable insert, and the tab hook extending in a second direction from an end of the support portion.

16. The casket insert of claim 15, wherein the removable insert includes a plurality of throughholes, each of the plurality of throughholes positioned to receive one of the plurality of spaced-apart extensions.

17. The casket insert of claim 13, wherein the removable insert includes a plurality of throughholes, each of the plurality of throughholes positioned to receive one of the plurality of spaced-apart extensions.

18. A method for use in a casket system, comprising:

a) sliding a removable casket insert into a casket container by rolling the casket insert over at least some of a plurality of rollers disposed in the casket container;

b) engaging the removable insert with a plurality of spaced-apart extensions disposed at the edge of a crossbar positioned proximate a head end of the casket container, the crossbar securely coupled to a worm nut, the worm nut rotatable engaging a worm screw; and c) rotating a worm screw to cause axial movement of the crossbar and at least a portion of the casket insert; and wherein the worm screw is rotatably mounted to a wall of the casket container and is disposed external to the casket insert at least during step a).

19. The method of claim 18, wherein step b) further comprises inserting the plurality of spaced-apart extensions into throughholes in the casket insert.

* * * * *